US008354938B2

(12) United States Patent
Garcia

(10) Patent No.: US 8,354,938 B2
(45) **Date of Patent: *Jan. 15, 2013**

(54) SAFETY WARNING SYSTEM AND METHOD

(76) Inventor: Rodolfo Garcia, Studio City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/373,987

(22) Filed: Dec. 7, 2011

(65) Prior Publication Data

US 2012/0139719 A1 Jun. 7, 2012

Related U.S. Application Data

(63) Continuation of application No. 12/803,999, filed on Jul. 12, 2010, now Pat. No. 8,085,161, which is a continuation-in-part of application No. 12/077,423, filed on Mar. 19, 2008, now Pat. No. 7,755,504.

(51) Int. Cl.
*G08B 21/00* (2006.01)

(52) U.S. Cl. ..... 340/686.1; 340/457; 340/500; 340/506; 340/522; 340/665; 340/666; 219/445.1; 219/446.1

(58) Field of Classification Search ..... 340/500, 340/506, 522, 573.1, 457, 686.1, 568.1, 665, 340/666, 309.3, 309.4; 219/445.1, 446.1, 219/457.1, 481, 490

See application file for complete search history.

(56) References Cited

U.S. PATENT DOCUMENTS

| | | | | |
|---|---|---|---|---|
| 4,630,110 | A * | 12/1986 | Cotton et al. | 348/153 |
| 4,870,405 | A * | 9/1989 | Fletcher | 340/568.1 |
| 5,638,046 | A * | 6/1997 | Malinowski | 340/539.17 |
| 6,778,090 | B2 * | 8/2004 | Newham | 340/573.1 |
| 7,693,590 | B2 * | 4/2010 | Nelson | 700/80 |
| 2003/0063010 | A1 * | 4/2003 | Smith et al. | 340/686.1 |
| 2007/0152837 | A1 * | 7/2007 | Bischoff et al. | 340/573.1 |

* cited by examiner

*Primary Examiner* — Hung T. Nguyen
(74) *Attorney, Agent, or Firm* — Colin P. Abrahams

(57) ABSTRACT

An appliance warning system comprises a floor pad which has a switch movable between an open position when no weight pressure is detected and a closed position when activated by weight pressure. A transmitter transmits a signal depending upon whether the switch is in the open or closed position. A remotely located module has a receiver for the signal from the transmitter. A control circuit is operational between a ready state before the switch is activated to the closed position and a monitoring state after the switch is activated. A warning device is activated by the control circuit when in the monitoring state when the switch has been in the open position for a preselected period of time after having been in the closed position. A reset switch resets the control circuit from the monitoring state to the ready state.

13 Claims, 2 Drawing Sheets

SAFETY WARNING SYSTEM AND METHOD

CROSS REFERENCE TO RELATED APPLICATIONS

This application is a continuation of U.S. patent application Ser. No. 12/803,999, U.S. Pat. No. 8,085,161 filed Jul. 12, 2010, which is a continuation-in-part of U.S. patent application Ser. No. 12/077,423 filed Mar. 19, 2008, now U.S. Pat. No. 7,755,504 dated Jul. 13, 2010, all incorporated by reference in their entirety.

FIELD AND BACKGROUND OF THE INVENTION

The present invention relates generally to an apparatus that alerts and warns a user of an appliance such as a stove or oven, or any other device or situation which may be monitored, either visually, audibly or by some other sensory means, that a cooking or other process has been initiated and requires monitoring and attention. Over a cyclic period of time the user, such as a cook, is signaled to return to, for example, the appliance and the cooking process, and hence to the source of combustion (i.e. the stove top burners, the oven, broiler, etc.) until the cooking process is completed or otherwise terminated. In this way, the risk of accidental damage which may arise due to overheating, combustion and possible kitchen fire due to an unattended cooking process is greatly reduced. The invention may be applied not only to cooking and kitchen monitoring, but to any other process or situation where such monitoring may be useful, for safety or other reasons. Some of these situations are described herein, but the invention is not limited to the specific examples which may be enumerated herein. In this specification, therefore, a specific reference of the applicability of the invention to cooking or other monitoring situations is to be interpreted broadly as encompassing any of a plurality of situations where the apparatus of the invention may be used.

Every year, thousands of people are killed or injured in house fires or other home related accidents. Some current statistics indicate that deaths from fires and burns are the fifth most common cause of unintentional injury and deaths in the United States and the third leading cause of fatal home injury. Sources indicate that in 2006 fire departments responded to 412,500 home fires in the United States, which claimed the lives of 2,580 people (not including firefighters) and injured another 12,925, not including firefighters. Some statistics and sources also indicate that 4 out of 5 fire deaths in 2005 occurred in residences and that cooking was the primary cause of these fires. Often, for example, cooking related fires are caused by unattended utensils which may be left on heating elements or gas flames. A common scenario involves an elderly person who initiates a cooking procedure and then forgets that food is cooking because of distractions such as a long telephone conversation; disease (Alzheimer's is an example), other impairment or just simple forgetfulness and absent-mindedness. Furthermore, unattended food left cooking on a burner may dry and overheat, and this scenario can lead to combustion and smoke. If cooking oil is involved, combustion can quickly result and produce an uncontrollable fire in very little time.

One solution to this problem is an inexpensive apparatus that (1) directly detects a person's or user's presence in front of a cooking appliance before a cooking procedure is initiated, (2) automatically monitors a user's attention to the cooking process, and (3) automatically warns with an alarm or other signal the user if the cooking process is left unattended.

SUMMARY OF THE INVENTION

According to one aspect of the invention, there is provided a warning system comprising: a floor pad for location on or adjacent a device such that a user must stand on the floor pad in order to normally use the device; at least one switch formed in or on the floor pad, the switch being sensitive to weight pressure on the floor pad, the switch being movable between an open position when no weight pressure is detected on the floor pad and a closed position when the switch is activated by weight pressure detected on the floor pad; a control circuit in or on the floor pad and connected to the switch for determining when the switch is in the open position or the closed position, the control circuit being operational between a ready state before the switch is activated from the open position to the closed position and a monitoring state after the switch is activated to the closed position; a warning device connected to the control circuit, the warning device being activated by the control circuit when in the monitoring state when the control circuit determines that the switch has been in the open position for a preselected period of time after having been in the closed position; and a reset switch on the floor pad for resetting the control circuit from the monitoring state to the ready state.

Preferably, the floor pad is substantially rectangular and the switch and control circuit are embedded in the floor pad. In one form, the at least one switch comprises a plurality of momentary switches embedded in the floor pad.

Preferably, the control circuit restarts the preselected period of time when the switch is closed during the monitoring state. The reset switch may be located near an edge of the floor pad and is activated by the user with a foot. Further, the warning device may be selected from the group consisting of: piezo crystal, a bell, a buzzer, a speaker, a horn, a strobe light, or any combination thereof.

According to another aspect of the invention there is provided a warning system comprising: a pad for location on or adjacent a device such that a user must stand on the pad in order to normally use or monitor use of the device, the pad having at least one switch formed in or on the pad which is movable between an open position when no weight pressure is detected on the pad and a closed position when the switch is activated by weight pressure detected on the pad, and a transmitter for transmitting a signal depending upon whether the switch is in the open or closed position; a module remote from the pad, the module comprising a receiver for receiving the signal from the transmitter, and a control circuit connected to the receiver and operational between a ready state before the switch is activated from the open position to the closed position and a monitoring state after the switch is activated to the closed position; a warning device connected to the control circuit, the warning device being activated by the control circuit when in the monitoring state when the control circuit determines that the switch has been in the open position for a preselected period of time after having been in the closed position; and a reset switch for resetting the control circuit from the monitoring state to the ready state.

The reset switch may be located on the floor pad and/or [010] on the module. The module may powered by an AC power source, or by a DC power source.

Preferably, the control circuit restarts the preselected period of time when the switch is closed during the monitoring state. The reset switch may be located near an edge of the floor pad and is activated by the user with a foot.

In one embodiment the module further comprises a power line carrier circuit transmitter for transmitting signals to selected devices connected to an electrical system which supplies the module with power. The power line carrier circuit may be an X-10 power line carrier which superimposes a 120 Hz coded signal over existing 60 Hz Ac wiring in the electrical system.

According to yet a further aspect of the invention, there is provided a safety monitoring system comprising: a device including a pad or mat for placing at an area to be monitored; a switch mechanism for placing the device in a resting state; an activating event effected by altering the mat or pad from its resting state to an active state; a normal range window of time for monitoring the area for any further incident; and resetting to the normal range or initiating an active response depending on the activity during the normal range window of time.

DETAILED. DESCRIPTION OF THE INVENTION

Figure 1:
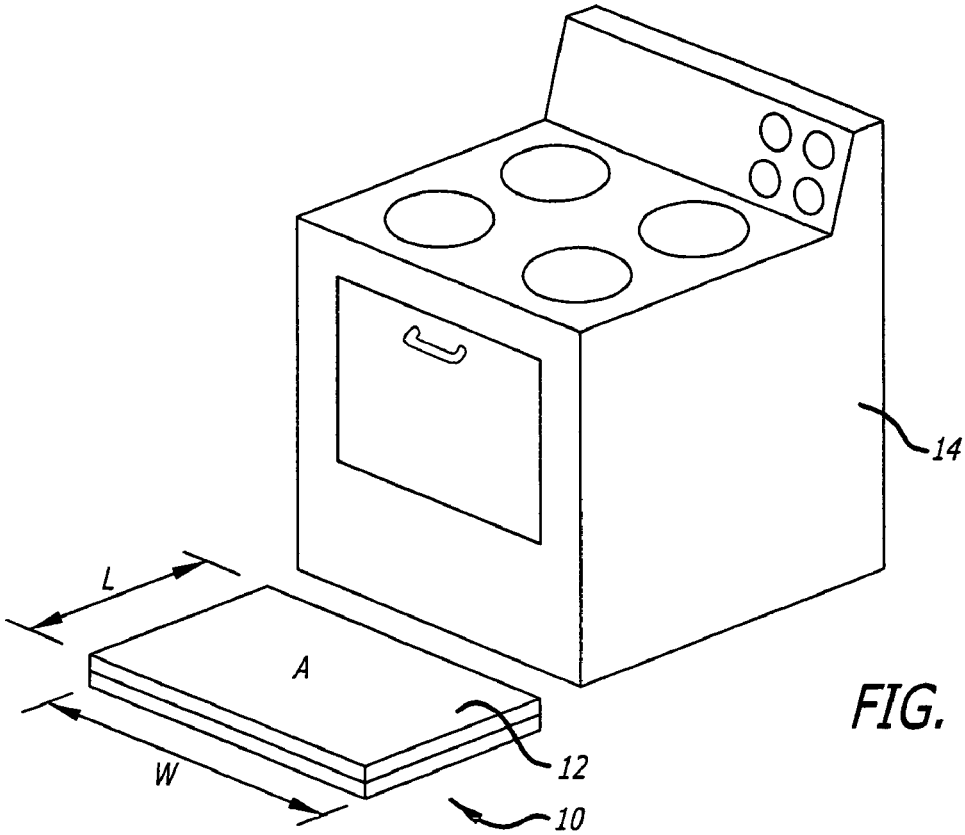
FIG. 1 is a perspective view of an appliance in the form a stove and warning device in accordance with on embodiment of the present invention.

With reference to FIG. 1 of the drawings, in one embodiment of the invention, the invention comprises a sensing device 10 including a floor pad 12. The floor pad 12 will preferably, but not necessarily, be sized and configured with dimensions approximately equivalent to the floor space typically required to use the cooking appliance 14. The floor pad 12 may be rectangular, semi-lunar, or another shape so long as a person using the cooking appliance 14 must normally stand on it in order to use the appliance 14. Of course, the floor pad 12 may be of any suitable shape depending upon the context of application. The sensing device 10 may be used in many situations other than with a stove or cooking device, and some of these other applications are set forth in this specification.

Figure 2:
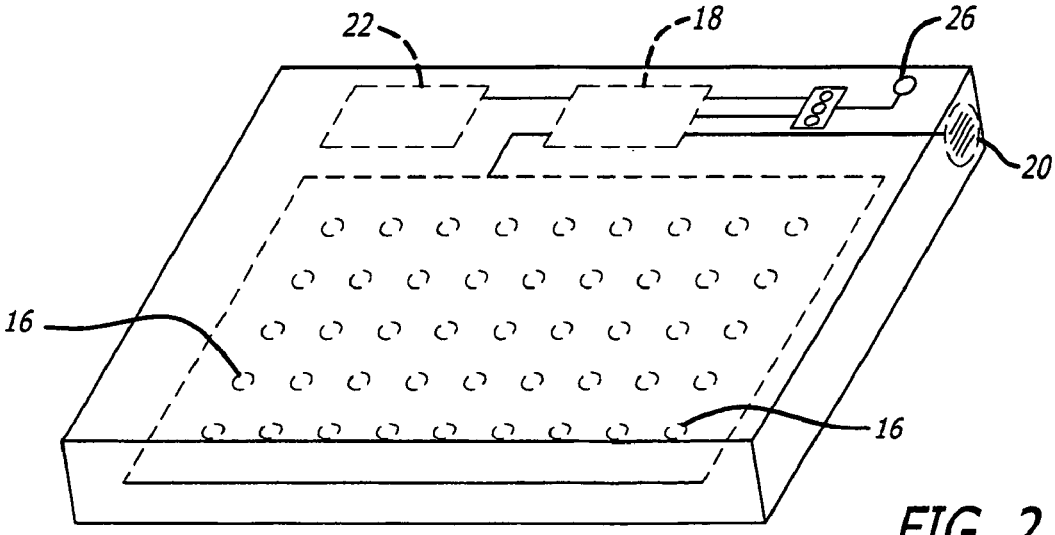
FIG. 2 is a detailed perspective view of a floor pad in accordance with the warning system of the invention.

The floor pad 12 is preferably constructed of a suitable polymeric thermoplastic, rubber, foam, gel or combination thereof so a resilient, shock absorbing surface is provided for comfort and functionality. The floor pad 12 contains a pressure sensitive, normally open, momentary switch or switches 16 (such as membrane switches) interspersed equally and imbedded within the floor pad 12 so that a person standing on the pad 12 must depresses one or more switches 16, as shown in FIG. 2 of the drawings. Any suitable arrangement incorporating electronic, electro mechanical, mechanical or electro-optical methods may be employed to configure a weight sensitive switch 16 that is momentary and normally open. The weight required to depress and momentarily close a switch 16, or signal the presence of a load on the floor pad 12, would fall within a range equivalent to the average human weight range, for example, 75 to 300 lbs.

Once a switch 16 of the floor pad 12 is depressed and thereby closed, an internal (within the floor pad 12) or external (outside the floor pad 12) populated printed circuit board or PCB (see FIG. 2) is triggered or activated by an appropriate signal form the floor pad 12 switches 16. The PCB 18 contains a circuit that monitors the open or closed condition of the floor pad 12 switch 16, a timing circuit, a power status circuit, a ON-OFF-READY indicating circuit, an alarm or signaling circuit and an electronically connected alarm or signaling device 20, such as, for example, a piezo crystal, a bell, a buzzer, a speaker, a horn, a strobe light, an RF interface to other appliances, lights, and/or a power line carrier interface to other appliances.

A power supply unit 22 is provided. The electromotive force or power supply from the power supply unit 22 required to power the PCB 18 may be comprised of a replaceable dry cell battery, rechargeable battery, AC transformer or other suitable power source.

In one embodiment of the invention as shown in FIGS. 1 and 2 of the drawings, the floor pad 12 switch or switches 16, PCB 18, power supply 22, and alarm 20 are completely self contained or embedded within the floor pad 12. In this particular embodiment, a person must stand on the floor pad 12 in front of the cooking appliance 14, or other apparatus, to initiate a cooking or other procedure. When the person stands on the floor pad 12, the PCB 18 immediately detects the closed condition of the floor pad 12 switches 16 due to presence of the user, and then waits for an open condition to occur when the person leaves or steps off the floor pad 12. Once the open condition is detected, a non-user interfaced, preset timing cycle, for example, 7 minutes (although any suitable time delay can be selected) is initiated. If the person returns and steps onto the floor pad 12 before the timing cycle of 7 minutes (or other preset time) are over, the timing cycle will reset and wait for the person to leave the floor pad 12 to begin another 7 minute timing period. Resetting of the timing cycle continues as long as the person keeps returning to the cooking appliance 14. Eventually, one of two conditions will occur, as detailed further below.

Condition one: In this scenario, the person returns to the cooking appliance 14 (or to or form some other device or apparatus) within the selected timing cycle(s) (in this example, 7 minutes) and terminates the cooking (or other) procedure. At this point, the person depresses an optionally lighted (LED) reset switch 26 which is preferably located on the external upper surface of the floor pad 12 at a position which would not normally be stood upon by the person using the device so as to avoid inadvertent activation of the reset switch 26. Depression of the reset switch 26 on the floor pad 12 deactivates the PCB 18 and resets the system to a READY state. In the READY state, the PCB 18 will remain inactive until the next closed position of the floor pad 12 switches 16 is detected, and a new cooking (or other) procedure is initiated. If the person terminates the cooking (or other) procedure but forgets to depress the floor pad 12 reset switch 26, an internal alarm 20 will sound after the 7 minute timing cycle expires. The alarm 20 will continue to sound until the person returns to the floor pad 12 (and hence, in this example, the cooking appliance 14) and resets the system to the READY state.

Condition two: In this scenario, the person does not return to the cooking (or other) appliance 14 during the first or subsequent timing cycle(s) within the preset time (7 minutes in the present example, but reprogrammable as required). In this case the internal alarm 20 will sound until the person returns to the cooking appliance 14 (or other) and steps onto the floor pad 12 to either continue the cooking (or other) procedure and initiate a further 7 minute countdown period, or terminate the cooking (or other) procedure by pressing down on the reset switch 26. If neither of these events occur, the alarm 20 will continue to sound until the floor pad 12 reset switch 26 is depressed or the power available from the power supply unit 22 (5) is depleted.

Figure 3:
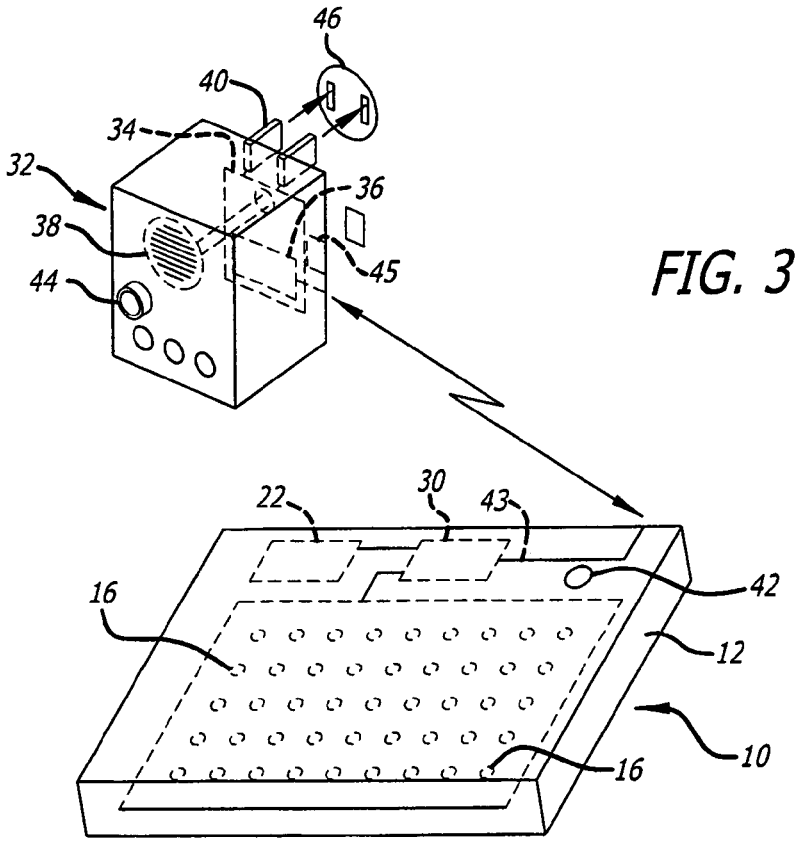
FIG. 3 is a perspective view of a floor pad and module box on the warning system in accordance with another embodiment of the present invention.

Reference is now made to FIG. 3 of the drawings which illustrates a further embodiment of the present invention. In this embodiment of this invention, all the electrical components are not self-contained within the floor pad 12. Instead, the floor pad 12 contains the pressure switch or switches 16 or other electronic, electro mechanical, mechanical or electro-optical means for detecting a weight load on the pad, a power supply unit 22, and an RF transmitter circuit 30. The power supply unit 22 powers the RF transmitter 30 contained within the floor pad 12. There are several ways for electronically configuring the RF circuit 30 that utilize standard, semi-custom and custom electronic components, such as ICs, resistors, capacitors, inductors, and so forth. An RF circuit capable of propagating a discrete, pulsed and coded electromagnetic signal is preferred in the context of this invention.

The open and closed position of the floor pad 12 switches 16 are detected, processed and modulated by a circuit that is continuous with the RF transmitter circuit 30. The modulated RF signal relays the closed or open position of the floor pad 12 switches 16 to a module 32 that is plugged into a nearby (i.e. in the kitchen if the appliance being monitored is the cooking appliance 14) electrical outlet. The module 32 houses a PCB 34 that includes: an RF receiver circuit 36 capable of detecting and decoding the modulated RF signal of the RF transmitter 30, a logic circuit, a timing circuit, an alarm or signaling circuit, a power status circuit, a ON-OFF-READY circuit, a reset circuit and a electronically connected internal module alarm 38, such as a piezo crystal, a bell, a buzzer, a speaker, a horn, a strobe light, and others, or a combination of such alarms. The PCB 34 is powered by the AC line 40.

The floor pad 12 may include a transmitting antenna 43 and the module 32 may contain a receiving antenna 45.

Operation of the apparatus is generally the same as the embodiment discussed above, except that the PCB 34 is external to the floor pad 12 and is remotely connected to the floor pad 12 through the RF transmission, namely the RF transmitter circuit 30 and the RF receiving circuit 36. This embodiment has certain advantages, some of which include: (1) the PCB 34 and the alarm 38 or signaling device are AC powered and less susceptible to power failure, and (2) a higher decibel alarm or more powerful alarm may be used since power drain, as from a dry cell battery, is a negligible factor. The floor pad 12 may have a reset switch 42 which may be located on the floor pad 12 (as in the first embodiment described above), or the rest switch 44 may be located on the outside face of module 32 that is plugged into an outlet 46 near the cooking (or other) appliance 14. Indeed, there may be both reset switches 42 and 44 within a given system in order to give the user the option of selecting one of these switches depending upon which of them may be more convenient to use in a given situation.

Figure 4:
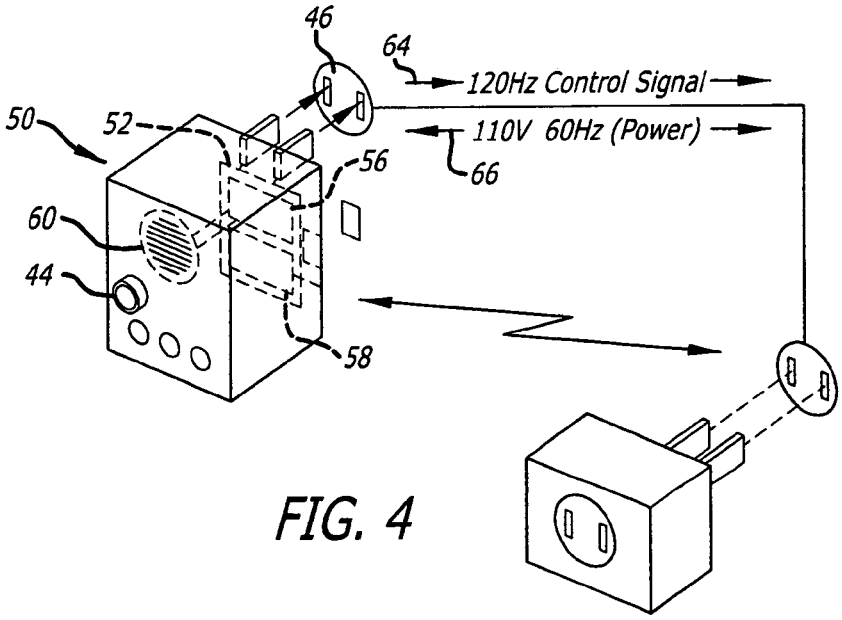
FIG. 4 is a detailed perspective view of a module of the warning system in accordance with the present invention.

Reference is now made to FIG. 4 of the drawings which shows a further embodiment of the invention. In this embodiment, the module 50 is very similar to the module 32 shown in FIG. 3 of the drawings in that it also contains the PC board 52 and internal alarm or signaling circuit. Further, the operation is essentially the same as in the embodiment illustrated in FIG. 2, but further includes an X-10 power line carrier (PLC) circuit 56, or a similar type of circuit capable of achieving substantially the same effect, that is able to superimpose a 120 Hz coded signal 64 over the existing 60 Hz AC wiring system 66 throughout the home or building. The superimposed signal can then control a variety of devices and appliances that are connected to the X-10 compatible receiver modules plugged into wall outlets throughout the house. Examples of devices that may be plugged into an X-10 compatible receiver module include: room lamps, strobe lights, PC controllers, high-decibel sounding devices, telephone dialers, existing light switches and receptacles, existing alarm systems, other appliances, and the like.

One advantage of the embodiment incorporating the X-10 compatible receiver, or a functional equivalent thereof, may be illustrated by the following example: A person initiates a cooking (or other) process and of necessity steps on and off the floor pad 12 depressing the imbedded floor pad switches 16. The closed or open condition of the floor pad 12 switches 16 is converted to a signal by a circuit that is continuous with the RF transmitter circuit located within the floor pad 12. The processed coded signal is then modulated and propagated as an RF signal to the module 50 that is plugged into an electrical outlet 46 near the cooking appliance (or other device), which may be somewhere in the kitchen. The RF signal is then processed by the RF receiver circuit 58 located on the PC board 52 housed within module 50. The processed signal activates the timing circuit within the PC board 52 housed within module 50 and a timing cycle (for example, 7 minutes) is initiated.

When the person does not return to the cooking (or other) appliance during the first or subsequent timing cycle(s) within the preset time (optionally 7 minutes), then the internal module alarm 60 housed within module 50 begins or continues to sound until one of the following events occur:

(1) the person returns to the cooking (or other) appliance, steps onto the mat and continues the cooking (or other) process, thereby resetting the timer to an additional 7 minutes;

(2) the person returns to the cooking (or other) appliance to terminate the cooking (or other) process and then depresses the floor pad reset switch 42 or module reset switch 44 to reset the system;

(3) the person returns to the cooking (or other) appliance to terminate the cooking (or other) process but forgets to reset the system by depressing the floor pad reset switch 42 or module reset switch 46, in which event the internal module alarm 60 will sound until the floor reset switch 42 or module reset switch 46 is depressed;

(4) the person fails to return to the cooking (or other) appliance, for example, after 3 timing cycles or 21 minutes. If the person has not returned to the cooking (or other) appliance or kitchen (or other) area to reset the system within 21 minutes the module 50 will activate one or more X-10 connected devices (i.e. room lamps, strobe lights, a PC controller, a high-decibel alarm, a bell, a siren, a horn, transceivers X-10 to RF and RF to X-10, a telephone dialer, etc.) to further alert the person or alert others such as neighbors, relatives, 911 emergency services, the fire department, as examples) of a potentially dangerous and life threatening situation. The use of X-10 or X-10 compatible interfaces becomes useful for persons having disabilities such as deafness. A bypass switch located on the module 50 may serve to bypass the audible alarm in favor of an X-10 device connected to a strobe light or multiple room lights to alert a deaf person in all signaling and alarm modes.

X-10 technology: X10 Power Line Carrier (PLC) technology was invented and patented in the late 1970s and opened up a whole new world of remotely controlling almost anything plugged into the electrical power line, without adding any control wiring. Basically, the X10 power line signaling technique consists of superimposing and transmitting a 120 khz coded signal on the 60 hz electrical power line. Using X10 transmitting device(s), the signal is sent over the power line to X10 receiving device(s) which are programmed with the same House and Unit code. There are 256 different standard X10 codes available (16 House codes: A through P, and 16 Unit codes: 1-16).

Various examples in which the monitoring and warning system of the invention may be used are set forth below.

As already mentioned above, the invention can be used as for safety purposes as a simple kitchen stove monitor mat.

The monitor mat would be dormant as long as the time monitored is, for example, less than a couple of minutes or so. The monitor would become active only after the user has been standing on it for "y" minutes, which may be considered the activating event. Once the monitor mat has been activated, and as long as the time spent standing on it is within the normal preselected range, the mat will keep resetting itself. When the user is finished with the designated task, the user will signal the monitor mat with some activity, such as by tapping twice on a corner thereof, which constitutes the normal reset action. However, if the normal reset action does not occur and the user steps away beyond the normal range, then the mat causes a beep, or voice to say something like "turn me off" (for a stove), or some other audible signal.

A further safety function of the invention may be when it is used as bedside monitor mat. This situation may also be used to operate in front of the shower, with different time parameters to help monitor or protect from strokes, accidents or the like when the user is in the shower. The system warning is dormant as long as the user steps on it for more than, say, 20 seconds, and would be in the resting state. The monitor mat would become active only after the user has not returned for y minutes, the activating event. Once activated, if the user returns and gets back in bed or back in the shower in less than, say, 15 minutes, the normal range, the system will re-set itself. After, say, 15 minutes, a light may turn on in a corner of the mat, and/or an alarm beeps, until the user taps on it, causing a normal reset. However, if the person is gone for more than, say, 25 minutes, and has not given the normal reset, then the mat may turn on a light, such as in a nurse station, or calls a designated caregiver.

A further safety function of the invention may be when it is used on a car, boat or heavy equipment. The monitor mat may be on the seat of the vehicle itself. It is dormant until a user sits down and while the motor is "ON" for more than, say, 5 minutes. Because it is self-activating, it begins to monitor the simultaneous presence of two states: (a) someone sitting on it, and (b) the motor being "ON". As soon as the motor is turned off, the system reverts back to the resting state. After, say, 2 to 5 seconds of the user being off the monitor mat while the motor is on, it will beep for a few seconds or until the user pinches, for example, a corner of the mat to initiate a normal reset. However, the alternative is that an alarm goes off in the vehicle and/or the motor is turned off with a wireless signal to the "Emergency Stop" (if available) switch to prevent further problems.

A further safety function of the invention may be when it is used in conjunction with drivers, pilots, truckers, security guards, and others, during long periods of sitting, which would be on the monitor mat (with auto timer+digital clock). The system is dormant until it is in use for over, say, 2 hours during the day, or 1 at night. After a preselected amount of time of continuous use it becomes active. Once active, the mat begins to randomly beep in two different tones for a few seconds during each 20 minute period. To reset it normally, the user must quickly pinch one or both front corners of the mat, or another designated component, within x number of seconds. However, the frequency or complexity of the required pinch pattern may keep increasing until the user stops the vehicle, calls the office or dispatcher, or carries out some other acceptable conduct.

A security function of the invention may be when it is used on floors in home or businesses such as building sites that cannot be fenced in easily. The resting state would be inactive. Once, for example, the front door is locked from the outside, the mats may be activated by, as examples, a signal from the door lock, a key remote or PC. The normal range in this situations would be an "all or none" configuration. When the same lock is reopened from the outside, the system would go back to the resting state only if the monitor has NOT been stepped on. However, if stepped on, range of responses may follow. These may include: a silent alarm via email from a PC or modern door lock; turn on web cam, sound alarm, flashing light, or alarm when front door is unlocked with key, to warn of the intruder.

A further security function of the invention may be when it is used to protect cars, trucks or heavy equipment in a simple and low cost manner. The system may be inactive until sat on, and may remain so for 5 minutes more (to provide time to put key in). After, say, 5 minutes, the mat sends an IR signal to a device in the key mechanism or door lock. The return signal indicates that the key is in the ignition (or equivalent situation for electronic starting) and/or that the door has been unlocked with a key. If normal entry and use has occurred after the user gets off, it again goes to the resting state. However, a signal orders an off switch in the electrical system to disable the vehicle or some other alarm where appropriate as an active response to an alert situation.

A further security function of the invention may be when it is used by convenience store clerks who may work alone and are vulnerable. The mat may have a vertical 8 inch splash section that serves as a "panic button" which can be kicked to set off. Once on, the normal resting state is that the mat randomly causes a phone to ring on the counter with a different ring tone than the usual. The clerk just picks it up or steps on a corner of the mat with a double tap. If the clerk does not do either after a, preselected number of minutes, or if the panic signal is made at any time, a real phone call is made by the system to a designated list of prioritized number or web addresses etc. complete with a AV feed from a web cam (if used) in the identified store. This could be sent to a "buddy clerk", or security, or police. The clerk answers the phone and either gives the OK or does not answer. In either event, the other party can assess the situation and take action as necessary. Of importance is that the assailant wold be unaware that he is being reported and taped and observed in real time.

An alternative set up is for the clerk to kick the panic section twice or jar the cash register to turn on the alarm, flashing red lights mounted outside the store and a recorded call for help to 911 "robbery in progress", or with the panic signal to the mat a mechanism is set off that pepper sprays the area in front of the counter at face level as well as another spray of bank money bag dye at the feet of the attacker, to aid in the pursuit later.

A further function of the invention may be when it is used as a pet service. Two or three monitor mats may be mounted on a wall or fence so that the longitudinal side is, say, 2 to 3 feet long and one foot above the floor. The mat may be 2 inches thick at the lower border. Hidden from view are a number of LEDs or red lasers aimed at the ground. These could be powered by solar cells like those in garden lights. It could also be made with a thick plastic tube inside a perforated metal pipe for durability. The resting state would be a period of no activity. The activating event may be as follows: An internal programmed circuit periodically causes the LEDs to shine down so as create an image on the ground. These light sources turn off and on quickly and in sequence so as to create the illusion of a projected rapidly "moving spot" of light back and forth the length of the 3 mats. The normal range may be set as any possible combination of sequence, rate or duration, and may even be random. At the end of each sequence, where the last light has shown, a pellet or treat is dropped as a "reward". This may occur sometimes, but not always. The pet dogs or even zoo animals are kept on their toes and alert with simulation of the real hunt with the built in elements of speed, random reward and stimulation.

The invention may also be used for survival purposes in the form of a mat that uses solar energy to charge a capacitor like electrical fly swatters except when stepped on and can shock or kill small animals. It charges itself and is inactive until turned on with a remote, as for cars. The activating event may occur once turned on and after being baited. It can be set to fire instantly or by remote as well. If and after the animal steps on the center surface made up of crisscrossed live wires, the animal is delivered a shock and dies or is stunned. The system could be configured to just punish the animal that ventures into the wrong area, with an electrical shock. Because it can be set oft with a key or other remote, it can also be used in a pond or river to stun fish.

The following shows in tabular form some of the embodiments and variations thereof described above.

| Device Use | (RS) Resting State | (AE) Activating Event | (NR) Normal Range | Either (NS) Normal Reset/ . . . OR-> | (AR) Active Response |
|---|---|---|---|---|---|
| Safety: Simple Kitchen Stove M-mat | The M-mat is dormant as long as the time on it is say, less than a couple of minutes RS < x | The M-mat becomes active only after the user has stood on it for ""y"" minutes, the AE | Once activated, as long as the time spent standing on it is within the NR, the mat keeps resetting itself. | When finished, the user signals the M-mat with some activity, say ""tapping twice on a corner"" the NS OR-> | If the NS does not occur and the user steps away beyond the NR, then the mat causes a beep or voice to say ""turn me off"" ie the stove |
| Safety: bedside M-mat. This would also function as a mat in front of the shower, with different time parameters to help protect from strokes in the shower | It's dormant as long as the user steps on it for more than 20 sec RS <x 20 sec. | The M-mat becomes active only after the user has not returned for y min, the AE | Once activated, as long as the user returns and gets back in bed in less than, say, 15 min., the NR, re-sets itself | After 15 min. a let turns on in a corner of the mat and/or beeps, until the user taps on it., NS. OR-> | If the person is gone for more than say, 25 min and has not given the NR , then the mat turns on a light in the nurse station or calls a designated caregiver. |
| Safety: Car, boat or heavy equipment M-mat would be on the seat itself. | It's dormant until a user sits down AND while the motor is ""ON"" for more than 5 minutes. | Because it is self- activating it begins to monitor the simultaneous presence of two states: a) someone sitting on it b) the motor ""ON"" | As soon as the motor is turned off it reverts back to the Resting State (RS) | After 2-5 seconds, of the user being Off the M-mat while the motor is On . . . it beeps for a few seconds or until the user pinches a corner of the mat the NS. OR-> | An alarm goes off in the vehicle and/or the motor is turned off with a wireless signal to the Emergency Stop switch to prevent further problems |
| Safety: Drivers, pilots, truckers, security guards during long periods are sitting on a M-mat (with auto timer + digital clock) | It's dormant until it is in use for over, say 2 hours during the day or 1 at night | After x time of continuous use it becomes active. | Once active the mat begins to randomly beep in two different tones for a few seconds during each 20 min periods. | To reset it normally, the user must quickly pinch one or both front corners of the mat within x seconds. OR-> | The frequency or complexity of the required pinch pattern keep increasing until the user stops the vehicle, calls the office or dispatcher |
| Security: Simple M-mat(s) on floors in home or businesses such as building sites that can't be fenced in easily | inactive | Once the front door is locked from the outside the mats are activated by a signal from the Schlage door lock, key remote or PC | All or none | When the same lock is reopened from the outside they go back to RS only if they have NOT been stepped on Or-> | When stepped on: a range of responses ie silent alarm via email from PC or modern door lock; turn on web cam, sound alarm, flashing light, or alarm when front door is unlocked with key, to warn of intruder. |
| Security: To protect car, trucks or heavy equipment in a simple low cost manner | Inactive until sat on, and remains so for 5 min more (to give time to put key in | After 5 min the mat sends IR signal to device in key mechanism or door lock. | The return signal indicates that the key is in and/or door has been unlocked with key | If normal entry and use has occurred after user gets off, it again goes to RS OR-> | A signal orders an off switch in electrical system to disable the vehicle or some other alarm |

-continued

| Device Use | (RS) Resting State | (AE) Activating Event | (NR) Normal Range | Either (NS) Normal Reset/ . . . OR-> | (AR) Active Response |
|---|---|---|---|---|---|
| Security: Convenience store clerks who works alone and are vunerable The mat has a vertical 8 in splash section that serves as a ""panic button"" which can be kicked to set off | Once on, the normal RS is that the mat randomly causes a phone to ring on the counter with a different ring tone than the usual. The clerk just picks it up or steps on a corner of the mat double tap | If the clerk does not do either after x minutes, OR if the panic signal is made at any time, a real phone call is made by the mat to a designated list of prioritized web addresses complete with a AV feed from a web cam in the identified store. This could be a ""buddy clerk""/security or police | The clerk answers the phone and either gives the OK or doesn't answer, in either case the other party can see what is going on and can take action. The key is that tha assailant is unaware that he is being taped and observed in real time. | An alternative set up is for the clerk to kick the panic section twice or jar the cash register to turn on the alarm, flashing red lights mounted outside the store and a recorded call for help to 911 ""robbery in progress"" | Or/and with the panic signal to the mat a mechanism is set off that pepper sprays the area in front of the counter at face level as well as another spray of ""bank money bag dye at the feet of the attacker, to aid in pursuit later. |
| Pet services: Two or three M-mats mounted on a wall or fence so that the longitudinal side is 2 to 3 ft long and one foot above the floor. The mat is 2 in thich at the lower border. Hidden from view are a number of LEDs or red lasers aimed at the ground. This could be powered by solar cells like those in garden lights. This could also be made with a thick plastic tube inside a perforated metal pipe for durability | No activity | An internal programmed circuit that periodically causes the LEDs to shine down so as create an image on the ground. These light sources turn off and on quickly and in sequence so as to create the illusion of a projected rapidly ""moving spot"" of light back and forth the length of the 3 mats | Any possible combination of sequence, rate or duration can be set., even random. | At the end of each sequence, where the last light has shown, a pellet of treat ie dropped as a ""reward"" . . . sometimes . . . | The pet dogs or even zoo animals are kept on their toes and alert with simulation of a real hunt with the built in elements of speed, random reward and stimulation. |
| Survival: A mat that uses solar to charge a capacitor like those electrical fly swatters except when stepped on can shock/kill small animals | It charges itself and is inactive until turned on with a remote, as for cars. | Once turned on and after being baited . . . can be set to fire instantly or by remote as well. | Once after the animals steps on surface made up of crisscrossed live wires, the animal is delivered a shock and dies or is stunned | Could be configured to jsut punish the animal that ventures into the wrong area, with a electrical shock. | Because it could be set off with a key remote, could be used in a pond or river to stun fish |

The invention is not limited to the embodiments described herein or illustrated in the drawings.

The invention claimed is:

1. A warning system comprising:

a floor pad for location on or adjacent a device such that a user must stand on the floor pad in order to normally use the device;

at least one switch formed in or on the floor pad, the switch being sensitive to weight pressure on the floor pad, the switch being movable between an open position when no weight pressure is detected on the floor pad and a closed position when the switch is activated by weight pressure detected on the floor pad;

a control circuit in or on the floor pad and connected to the switch for determining when the switch is in the open position or the closed position, the control circuit being operational between a ready state before the switch is activated from the open position to the closed position and a monitoring state after the switch is activated to the closed position;

a warning device connected to the control circuit, the warning device being activated by the control circuit when in the monitoring state when the control circuit determines that the switch has been in the open position for a preselected period of time after having been in the closed position; and a reset switch on the floor pad for resetting the control circuit from the monitoring state to the ready state.

2. A warning system as claimed in claim 1 wherein the floor pad is substantially rectangular and the switch and control circuit are embedded in the floor pad.

3. A warning system as claimed in claim 1 wherein the at least one switch comprises a plurality of momentary switches embedded in the floor pad.

4. A warning system as claimed in claim 1 wherein the control circuit restarts the preselected period of time when the switch is closed during the monitoring state.

5. A warning system as claimed in claim 1 wherein the reset switch is located near an edge of the floor pad and is activated by the user with a foot.

6. A warning system as claimed in claim 1 wherein the warning device is selected from the group consisting of: piezo crystal, a bell, a buzzer, a speaker, a horn, a strobe light, or any combination thereof.

7. A warning system comprising:

a pad for location on or adjacent a device such that a user must stand on the pad in order to normally use or monitor use of the device, the pad having at least one switch formed in or on the pad which is movable between an open position when no weight pressure is detected on the pad and a closed position when the switch is activated by weight pressure detected on the pad, and a transmitter for transmitting a signal depending upon whether the switch is in the open or closed position;

a module remote from the pad, the module comprising a receiver for receiving the signal from the transmitter, and a control circuit connected to the receiver and operational between a ready state before the switch is activated from the open position to the closed position and a monitoring state after the switch is activated to the closed position;

a warning device connected to the control circuit, the warning device being activated by the control circuit when in the monitoring state when the control circuit determines that the switch has been in the open position for a preselected period of time after having been in the closed position; and a reset switch for resetting the control circuit from the monitoring state to the ready state.

8. A warning system as claimed in claim 7 wherein the module has display indicator lights thereon for indicating the status of the appliance warning system.

9. A warning system as claimed in claim 7 wherein the control circuit restarts the preselected period of time when the switch is closed during the monitoring state.

10. A warning system as claimed in claim 7 wherein the reset switch is located near an edge of the pad and is activated by the user with a foot.

11. A warning system as claimed in claim 7 wherein the module further comprises a power line carrier circuit transmitter for transmitting signals to selected devices connected to an electrical system which supplies the module with power.

12. A warning system as claimed in claim 11 wherein the power line carrier circuit is an X-10 power line carrier which superimposes a 120 Hz coded signal over existing 60 Hz Ac wiring in the electrical system.

13. A safety monitoring system comprising:

a device including a pad or mat for placing at an area to be monitored;

a switch mechanism for placing the device in a resting state;

an activating event effected by altering the mat or pad from its resting state to an active state;

a normal range window of time for monitoring the area in the active state to detect for any further incident;

resetting from the active state to the resting state after the normal range window of time has expired or initiating an active response according to the absence or presence of the activity during the normal range window of time.

* * * * *